United States Patent [19]

Toy et al.

[11] 4,430,089

[45] Feb. 7, 1984

[54] PROCESS FOR IMPARTING FLAME RETARDANCY TO FABRICS

[75] Inventors: Madeline S. Toy, Palo Alto; Roger S. Stringham, Woodside, both of Calif.

[73] Assignee: Science Applications, Inc., La Jolla, Calif.

[21] Appl. No.: 368,405

[22] Filed: Apr. 14, 1982

[51] Int. Cl.[3] ..... D06M 10/00; D06M 1/22; D06M 9/00

[52] U.S. Cl. ..... 8/115.5; 8/115.7; 204/159.12; 204/159.19

[58] Field of Search ..... 8/115.5, 115.7; 204/159.12, 159.19

[56] References Cited

U.S. PATENT DOCUMENTS

| | | | |
|---|---|---|---|
| 3,279,944 | 10/1966 | Prior | 8/115.5 |
| 3,423,163 | 1/1969 | Magat et al. | 204/159.12 |
| 3,549,306 | 12/1970 | Friedlander et al. | 8/115.5 |
| 3,617,191 | 10/1971 | Caldwell | 8/115.7 |
| 3,933,607 | 1/1976 | Needles et al. | 204/159.12 |
| 4,203,723 | 5/1980 | Fletcher et al. | 8/115.5 |
| 4,210,691 | 7/1980 | Bolgiano et al. | 8/115.5 |
| 4,278,703 | 7/1981 | Toy et al. | 204/159.22 |

*Primary Examiner*—Maria Parrish Tungol

*Attorney, Agent, or Firm*—Bruno J. Verbeck; Michael L. Slonecker

[57] ABSTRACT

A process for effecting flame retardation of fibrous structures, such as fabrics, particularly fabrics made from mixtures of natural and synthetic fibers, such as cotton and nylon. The process includes the steps of contacting the fabric to be treated with halomonomers and/or inorganic salts, followed by fluorocarbon grafting, and then by photohalogenation. The aforesaid treatment results in fabrics which are not only flame resistant but also have improved hand, manifested by softness, silkiness, and unwettability of the resulting fabric.

11 Claims, No Drawings

PROCESS FOR IMPARTING FLAME RETARDANCY TO FABRICS

BACKGROUND OF THE INVENTION

1. Field of the Invention

This invention relates to the production of commonly used fibrous structures, such as fabrics, and in particular fabrics formed from mixtures of synthetic and natural fibers such as nylon and cotton, which have a high degree of flame-retardancy coupled with softness, silkiness, and hydrophobicity.

2. Brief Description of the Prior Art

The production of fibrous structures such as textiles, from which may be formed clothing, filters, dustbags, and the like and which have flame-retardancy, has occupied workers in the field for a number of years as manifested, for example, by the procedures disclosed and claimed in such representative prior art as U.S. Pat. No. 3,549,307, issued Dec. 22, 1970, and U.S. Pat. No. 3,607,798, issued Sept. 21, 1971 to Hirsch; U.S. Pat. No. 4,203,723 issued May 20, 1980 to Toy and Stringham; the article entitled "Photoaddition of fluorolefins on Aromatic Polyamide" by Toy, Stringham, and Dawn, in the Journal of Applied Polymer Science, Volume 21, 2583–2588 (1977); and U.S. Pat. No. 4,278,703 Toy, Stringham, and Fogg issued July 14, 1981.

While the efforts represented by the prior art workers, illustrated above, have resulted in improvements in the flame retardation of certain types of fabrics or textiles, there remains a need for methods which would unlike the prior art procedures, impart a high degree of flame-retardancy, softness, silkiness, and nonwettability to, e.g. commonly used fabrics comprising mixtures of synthetic and natural fibers, such as mixtures of nylon and cotton.

SUMMARY OF THE INVENTION

A principal object of the invention is to provide a novel and improved process for imparting flame retardancy to fabrics.

A further object is to provide a new and improved process for imparting flame retardancy to fabrics without substantially decreasing the tear strength, or increasing the stiffness of the treated fabric.

Another object is to provide improved fabrics comprising mixtures of natural and synthetic fibers characterized by their increased resistance to flammability.

A still further object is to provide a new improved flame resistant fabric comprising a blend of cotton and nylon with enhanced properties of softness, silkiness, and unwettability.

The foregoing objects are achieved by means of the novel process of our invention wherein the textiles being treated for flame retardancy are first treated with an inorganic salt and/or halomonomer, followed by fluorocarbon grafting, and then followed by a treatment of the resulting fabric with photohalogenation.

The intial treatment of the fabric, which may be a mixture of nylon and cotton involves contacting the fabric either with an inorganic salt, or salts, or treating the fabric with halomonomers.

If the fabric is first treated with a salt, that treatment is effected by contacting the fabric with an aqueous solution of the salt followed by drying it, followed by subsequent treatment using fluorocarbon grafting, and that followed by photohalogenation.

If halomonomeric treatment is first given to the fabric, rather than treatment with the inorganic salt, the fabric is wetted with a solution containing the halomonomer, air dried, and then subjected to fluorocarbon grafting, followed by photohalogenation.

The salts which can be used in the aforesaid initial treatment of the fabric are, for example, magnesium sulfate, sodium fluoride, sodium borate, and the like. Inorganic salts were found to be more effective in reducing the acid degradation which results from subsequent treatment of the fabric being processed according to the present invention, than did bases, such as sodium hydroxide, buffers such as $KH_2PO_4$—NaOH at pH 8.0, $H_3BO_3$—NaOH at pH 9, or acid acceptors such as MgO and $Sb_2O_3$.

The halomonomeric compounds which may be used in the pretreatment of fabrics in accordance with the present invention are typified by the following: halogenated ketones (e.g., $CH_2Cl_2COCCl_3$, $CHCl_2COCHCl_2$, and $CCl_3COCCl_3$) anhydrides (e.g.,

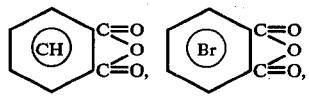

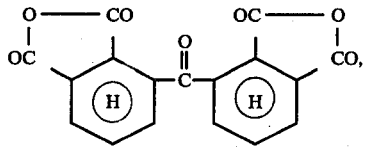

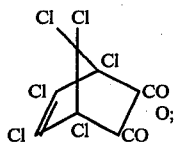

aromatics (e.g.,

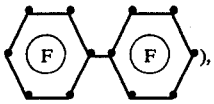

olefins (e.g. $CHBr{=}CBr_2$ and $CCl_2$); dienes (e.g., $CCl_2{=}CClCCl{=}CCl_2$); and carbonyl-containing heterocyclics (e.g.,

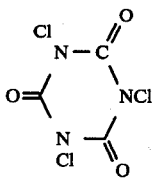

The treatment with the foregoing halomonomeric compounds is carried out by wetting the fabric with a solution of the halomonomer or by brushing a suspension of the halomonomers onto the fabric the halomonomer concentration being about 1 to 30 percent of the weight of the fabric, at ambient temperature, followed by drying.

The next step, fluorocarbon grafting of the inorganic salt or halomonomer treated fabric is carried out utilizing, as the fluorocarbon, such compounds as tetrafluoroethylene; hexafluorobutadiene; chlorotrifluoroethylene, 1,1-dichlorodifluoroethylene; bromotrifluoroethylene, and hexafluoroacetone, by contacting the treated fabric in a sealed chamber with the fluorocarbon, while irradiating the fabric with radiation of sufficient energy for a time sufficient to effect grafting of the fluorocarbon to the fabric. Of the foregoing compounds it was found that tetrafluoroethylene and hexafluorobutadine were particularly effective in providing nonwettability, silkiness, and chemical and soil resistance to the fabric. Somewhat less effective for that purpose were hexafluoroacetone, chloro and bromo-trifluoroethylene, and 1,1-dichlorodifluoroethylene.

The foregoing fluorocarbon grafting, following the pretreatment with salt, or with halomonomer further enhanced the flame retardancy as well as upgrading the nonwettability, silkiness, chemical and soil resistance of the untreated fabric, especially the synthetic-natural fiber blends.

A further step, photohalogenation, is carried out by contacting the fabric which has been pretreated with an inorganic salt, or halomonomer, followed by fluorocarbon grafting, with a halide such as phosphorus pentafluoride, boron trifluoride, silicon tetrafluoride, sulfur tetrafluoride, arsenic pentafluoride and antimony trichloride, while irradiating the fabric with radiation of sufficient energy for a sufficient time to effect reaction of the halide and the treated fabric. Phosphorus pentafluoride was particularly effective in increasing flame retardant performance, especially when followed by treatment with boron trifluoride and/or silicon tetrafluoride The fluorocarbons in the photografting are in gaseous or vapor form, it being understood that if the fluorocarbon is liquid at ambient temperature it may be vaporized by heating or other means known to the art.

It will also be understood that the fluorocarbon may be admixed with an inert diluent gas such as nitrogen or the like.

In carrying out the fluorocarbon grafting step, the pressure of the gaseous fluorocarbon is desirably maintained between about 20 mm Hg to about 1.5 atmospheres. The photolysis time may vary from about 2 minutes to 5 hours.

During photohalogenation, the pressure of the halide in the chamber may vary between about 10 and 800 mm Hg. Temperature may be between about 20° C. and 150° C., and photolysis time between about 2 and 30 minutes.

Apparatus for carrying out the steps of the present invention comprises a closed chamber which can be evacuated, the chamber being provided with means for introducing the gaseous medium such as fluorocarbons and halides. The apparatus includes also provisions for maintaining the irradiated surface of the fabric being treated at a substantial equal distance from the radiation source. Batch or continuous procedures may be used as those skilled in the art understand. A suitable irradiation source comprises ultraviolet light having a wavelength of approximately 1800 Å or greater. The intensity and the time of irradiation can of course vary; at higher intensities the grafting process and photohalogenation occur at a relatively higher rate than when the intensity of radiation is lower. Those skilled in the art will understand that the time and intensity of radiation will be such as to achieve the desired degree of reaction of the fluorocarbon and the halide to the fabric being treated.

Additional advantages of our invention will become apparent from the following description of preferred embodiments.

DESCRIPTION OF THE PREFERRED EMBODIMENTS

A. Fabric Pretreatment with an Inorganic Salt Followed by Photohalogenation

EXAMPLE 1

A specimen of 50/50 nylon/cotton woven fabric was pretreated by wetting the fabric with an aqueous sodium fluoride solution (13%) at ambient temperature, air dryed. The specimen was then suspended in a cylindrical Pyrex reaction vessel having a centered quartz sleeve for receiving a PenRay ultraviolet light. The reaction vessel was heated using a heating tape or infrared lamp. The reaction vessel was then evacuated after which a predetermined amount of phosphorus pentafluoride was introduced to a specified pressure, temperature, and photolysis time. The following reaction parameters were employed:

pressure: 510 mm Hg
photolysis time: 30 min.
temperature: 130° C.

At the end of 30 minutes the reaction vessel was evacuated, following which a predetermined amount of boron trifluoride was introduced at predetermined pressure, temperature, and photolysis time conditions. The following reaction parameters were used:

total pressure: 381 mm Hg
photolysis time: 15 min.
temperature: 130° C.

At the end of the irradiation time, the reaction vessel was evacuated and air introduced therein. The treated fabric sample was then washed with water and dryed for subsequent testing.

A flammability test was conducted on a specimen of the treated fabric sample (2.75×12 in) by means of a vertical flammability tester in accordance with Federal Test Method Standard No. 191 Method 5903. The flammability test result showed that the fabric was self-extinguishing.

EXAMPLE 2

The above procedure was followed except that the sodium fluoride pretreatment was replaced by the utilization of magnesium sulfate solution (6%) in the presence of sodium hydroxide (1.5%). A similar self extinguishing result utilizing the same vertical flammability test, was achieved.

B. Pretreatment of Fabric with a Halomonomer Followed by Fluorocarbon Photografting and then by Photohalogenation

EXAMPLE 3

A specimen of 50/50 nylon/cotton woven fabric was treated by wetting the fabric with a benzine solution containing an equal amount of pentachloroacetone $CCl_3COHCl_2$ and tetrachlorophthalic anhydride at ambient temperature, then air dried and suspended in a reaction vessel as in Examples 1 and 2. The reaction chamber was evacuated following which a measured amount of tetrafluoroethylene was introduced to a specified, pressure, and photolysis time, the following reaction parameters being employed:

total pressure: 510 mm Hg photolysis time: 10 min.
temperature: 50° C.
At the end of the photolysis time the reaction vessel was evacuated following which a measured amount of phosphorous pentafluoride was introduced to a specified pressure, temperature, and photolysis time, the following reaction parameters being employed:
total pressure: 252 mm Hg
photolysis time: 3 min.
temperature: 50° C.
At the end of the photolysis time the reaction vessel was again evacuated and air introduced. The treated specimen was then washed with water and dried for subsequent testing.

The treated substrate was found to be softer, silkier, and more hydrophobic as compared with the untreated 50/50 specimen of nylon/cotton. The treated fabric was also found to be flame resistant by Federal Test Method Standard No. 191 Method 5903.

EXAMPLE 4

A speciment of 65/35 polyester/cotton woven fabric was pretreated by brushing the fabric with a diethyl ether suspension of equal parts of 3, 3', 4, 4'-benzophenonetetracarboxylic anhydride, tribromoethylene, and tris(2,3-bromopropyl)phosphate at ambient temperature, air-dried, and suspended in a reaction vessel of the kind referred to in the previous examples. The reaction vessel was evacuated following which a predetermined amount of chlorotrifluoroethylene was introduced to a specified pressure temperature and photolysis time, the following parameters being used:
total pressure: 760 mm Hg
photolysis time: 90 min.
temperature: 30° C.
After the photolysis time of 90 minutes, the reaction vessel was evacuated, and a predetermined amount of phosphorus pentafluoride introduced to a specified pressure, temperature, and photolysis time, the following reaction parameters being employed:
total pressure: 305 mm Hg
photolysis time: 5 min.
temperature: 30° C.
A flammability test was conducted on a specimen of the thus treated fabric by a vertical flammability test (Federal Test Method Standard No. 191 Method 5903). The flammability test result showed no afterflame, no afterglow, and the product was self-extinguishing, with a charr length of 3.5 inches.

C. Pretreatment of Fabric with Halomonomer Followed by Photolysis under an Inert Atmosphere Followed by Photohalogenation

EXAMPLE 5

The procedure of Example 3 was followed in treating a specimen of 50/50 nylon/cotton, except that in the second step tetrafluoromethane (inert) instead of tetrafluoroethylene was introudced using the following parameters:
total pressure: 510 mm Hg
photolysis time: 120 min.
temperature: 130 C.
and the following parameters used for the phosphorus pentafluoride treatment:
total pressure 254 mm Hg
photolysis time: 5 min.
temperature: 130° C.
The treated specimen was flame resistant (by Federal Test Method Standard No. 191 Method 5903), but did not exhibit softness, silkiness, and unwettability as did the fabric treated in accordance with Example 3.

D. Pretreatment of Fabric with Halomonomer Followed by Photohalogenation

EXAMPLE 6

The procedure of Example 3 was followed except that the fluorocarbon photografting step was omitted. The resulting treated fabric was flame resistant but did not exhibit added softness, silkiness, and non-wettability properties.

Our invention, which is particularly applicable to the treatment of fabrics comprising mixtures of natural and synthetic fibers results in fabrics which have substantially improved properties of flame resistance, softness, silkiness, chemical and soil resistance, and unwettability, which are particularly useful in the mass production of clothing, such as uniforms and furnishing fabric.

While fluorocarbon grafting alone did not provide as much flame retardancy of cellulosic/synthetic blend fabrics as would be desired, the combination of halomonomer pretreatment and salt pretreatment improved the flame retardancy and break strength of the fabric, together with enhancement of the other properties above-described.

The detailed description of our invention, as shown above, is to provide clarity and understanding. While preferred embodiments have been shown, it will be understood that various changes may be made therein without departing from the spirit and scope of the invention as defined in the appended claims. To that extent such variant forms are considered to be within the scope and essence of our invention.

What is claimed is:

1. A process for imparting improved flame retardation, hand and hydrophobicity to a fibrous structure which comprises contacting said structure with a member selected from the group consisting of alkali and alkaline earth inorganic salts and halogenated organic monomers and then subjected the resulting structure to fluorination by a covalent fluoride in gaseous form.

2. A process for imparting improved flame retardation, and hydrophobicity to a fibrous structure which comprises, sequentially, (a) contacting said structure with a member selected from the group consisting of alkali and alkaline earth inorganic salts and halogenated organic monomers;

(b) then contacting the resulting structure with a fluorocarbon in gaseous form while exposing the structure to ultraviolet radiation at a temperature and for a time sufficient to cause grafting of the fluorocarbon on to the structure, and (c) contacting the resulting structure with a covalent fluoride in gaseous form while exposing the resulting structure to ultraviolet radiation at a temperature and for a time sufficient to effect reaction with the resulting structure.

3. A process in accordance with claim 2 wherein the member of step (a) is an inorganic salt in aqueous solution.

4. A process in accordance with claim 2 wherein the halogenated organic monomers of step (a) is a member selected from the group consisting of halogenated ketones, halogenated aromatics, halogenated olefins, halogenated dienes, halogenated carbonyl-containing heterocyclics and mixtures thereof.

5. A process in accordance with claim 2 wherein the covalent fluoride of step (c) is a member selected from the group consisting of phosphorus pentafluoride, boron trifluoride, silicon tetrafluoride, sulfur tetrafluoride, arsenic pentafluoride, antimony trichloride, and mixtures thereof.

6. A process in accordance with claims 1 or 2 wherein the fibrous structure is a fabric comprising a mixture of synthetic and natural fibers.

7. A process in accordance with claims 1 or 2 wherein the inorganic salts are members of the group consisting of halides, sulfates, and borates.

8. A process in accordance with claim 6 wherein the synthetic fibers are nylon and the natural fibers are cotton.

9. A process in accordance with claim 9 wherein the ratio of nylon to cotton is about 50/50.

10. A process in accordance with claim 6 wherein the synthetic fibers are polyester and the natural fibers are cotton.

11. A process in accordance with claim 10 wherein the ratio of polyester to cotton is about 65/35.

* * * * *